US006986750B2

(12) United States Patent
Lortscher

(10) Patent No.: US 6,986,750 B2
(45) Date of Patent: Jan. 17, 2006

(54) ATHLETIC PROTECTIVE CUP SUPPORTER

(76) Inventor: Lane Lortscher, 18037 Martha St., Encino, CA (US) 91316

( * ) Notice: Subject to any disclaimer, the term of this patent is extended or adjusted under 35 U.S.C. 154(b) by 162 days.

(21) Appl. No.: 10/830,904

(22) Filed: Apr. 22, 2004

(65) Prior Publication Data

US 2005/0010156 A1 Jan. 13, 2005

Related U.S. Application Data

(60) Provisional application No. 60/465,167, filed on Apr. 23, 2003.

(51) Int. Cl.
*A61F 13/00* (2006.01)

(52) U.S. Cl. ..... 602/70; 128/100.1

(58) Field of Classification Search ..... 602/67–73; 2/466; 128/100.1
See application file for complete search history.

(56) References Cited

U.S. PATENT DOCUMENTS

| | | | | | |
|---|---|---|---|---|---|
| 2,986,396 | A | * | 5/1961 | Abbott et al. | 473/502 |
| 3,788,314 | A | | 1/1974 | Noreen | |
| 3,963,022 | A | | 6/1976 | Rotello | |
| 4,304,403 | A | * | 12/1981 | Wilson | 473/502 |
| 4,651,989 | A | * | 3/1987 | Wilson | 473/502 |
| 5,003,972 | A | | 4/1991 | Kestler | |
| 5,012,802 | A | * | 5/1991 | Bischoff | 602/73 |
| 5,709,621 | A | * | 1/1998 | Wilson | 473/502 |
| 6,004,232 | A | * | 12/1999 | Sennott | 473/502 |
| 6,241,631 | B1 | * | 6/2001 | Wilson | 473/502 |

* cited by examiner

*Primary Examiner*—Kim M. Lewis
(74) *Attorney, Agent, or Firm*—Kelly Lowry & Kelley, LLP

(57) ABSTRACT

An athletic protective cup supporter includes a waistband, a cup supporting pocket connected to the waistband, and a strap extending from the waistband to an end having a resilient clip.

17 Claims, 1 Drawing Sheet

ATHLETIC PROTECTIVE CUP SUPPORTER

RELATED APPLICATION

This application claims the benefit of U.S. Provisional Application No. 60/465,167, filed on Apr. 23, 2003.

BACKGROUND OF THE INVENTION

The present invention generally relates to an athletic protective cup supporter. More particularly, the present invention relates to an athletic supporter that includes an easily recognized visible indicia to aid in verifying that the athletic protective cup supporter is being worn.

An athletic supporter protective cup is a protective device that is worn by men and boys participating in athletic activities. Safety equipment varies from sport to sport, but many sports, such as baseball, require male participants to wear an athletic protective cup. Similar needs are also present with football, soccer and other sports. While it is not widely recognized that when involved in sporting activities, it is imperative to minimize exposure to injury. Athletic protective cup protection is considered imperative to the safety of those participating in sports activities where injury to the groin is possible.

Traditionally, the athletic supporter is worn by a user beneath pants, shorts and other clothing associated with a sport's uniform. The typical athletic supporter presently available consists of a panel of material which terminates between the wearer's legs, at which point support straps are attached. The typical athletic supporter is made of a heavy duty elasticized material. See, for example, U.S. Pat. No. 5,003,972, the contents of which are incorporated herein.

In order to address concerns relating to the protection of athletes from groin injuries, athletic leagues have instituted regulations that all players must wear protective cups and need to provide visual indicia that the cups are being worn. Conventional athletic supporters fail to provide this visual indicia.

Accordingly, there is a need for a means to identify individuals wearing athletic supporters which is simplified in its construction and application. There is a further need for easily recognized visible indicia to aid in verifying that the athletic protective cup supporter is being worn. The present invention fulfills these needs and provides other related advantages.

SUMMARY OF THE INVENTION

The present invention resides in an improved athletic protective cup. In a preferred form of the invention, an athletic protective cup supporter includes a waistband, a cup supporting pocket connected to the waistband, and an elongated strap extending from the waistband and terminating at a resilient clip.

The cup supporter further includes a connector for attaching the strap and the waistband. The connector includes a male portion and a female portion operationally engaging the waistband therebetween.

The cup supporter further includes an aperture on the waistband, and the connector includes a male portion insertable through the aperture to engage a female portion of the connector. The male and female portions operationally engage the waistband therebetween.

The aperture is located through the waistband opposite the cup supporting pocket.

The cup supporter also includes an identification tag associated with the clip.

The waistband comprises a portion of an inner garment, and the clip operationally engages a waistband of an outer garment. The cup is located in the cup supporting pocket and the pocket is sewn shut.

A method for identifying an athlete wearing an athletic protective cup supporter involves connecting a first end of an elongated strap to a waistband of an inner garment having a cup supporting pocket holding a protective cup.

The elongated strap is looped from the waistband of the inner garment to a waistband of an outer garment in an area between the inner and outer garments. The looping further includes folding the strap around a shirt tail tucked into the area between the inner and outer garments.

A second end of the strap is attached to the waistband of the outer garment.

An identification tag is secured on the second end of the strap.

As part of connecting the first end of the elongated strap to the waistband of the inner garment, a male portion of the strap is inserted through an aperture of the waistband of the inner garment to engage a female portion of the strap, operationally engaging the waistband of the inner garment therebetween. Another part of connecting the first end of the elongated strap to the waistband of the inner garment includes placing the protective cup in the cup supporting pocket.

Other features and advantages of the present invention will become apparent from the following more detailed description, taken in conjunction with the accompanying drawings which will illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
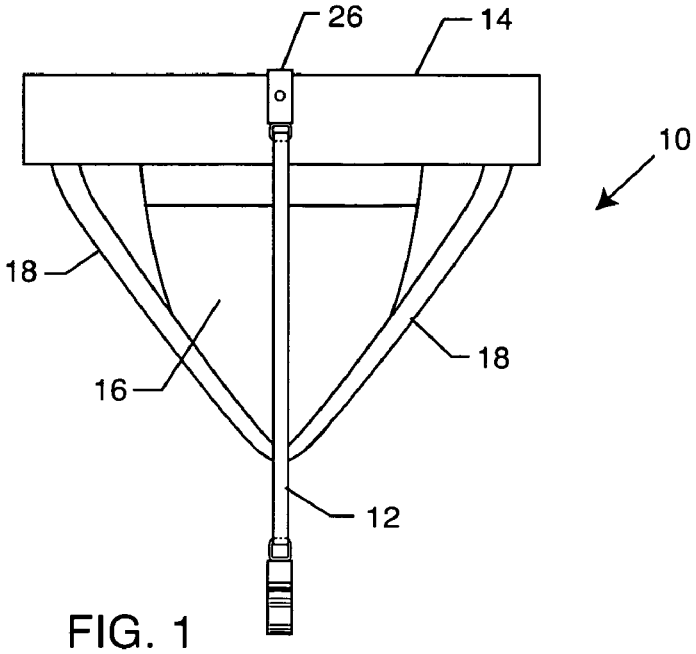
FIG. 1 is a rear elevational view of an athletic supporter embodying the present invention including an identification strap.
Figure 2:
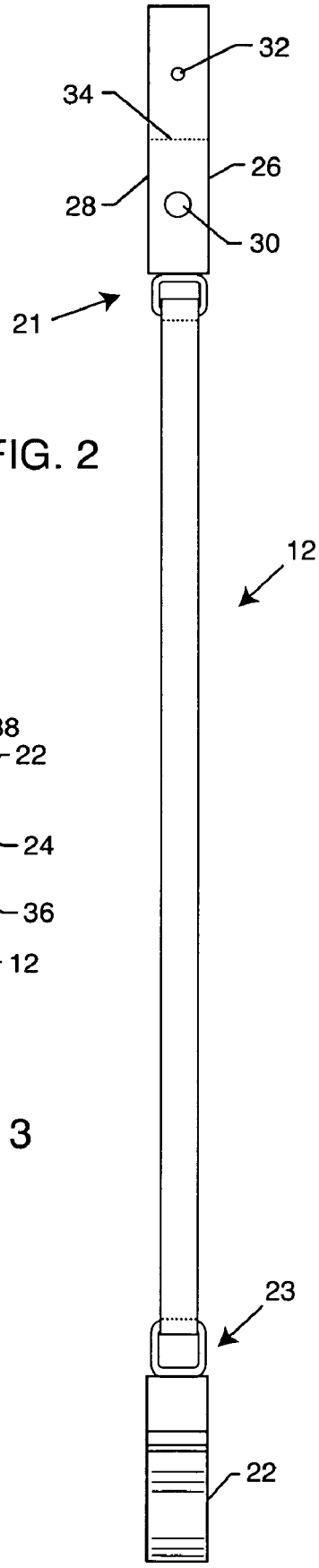
FIG. 2 is a top plan view of the identification strap of the athletic supporter of FIG. 1.
Figure 3:
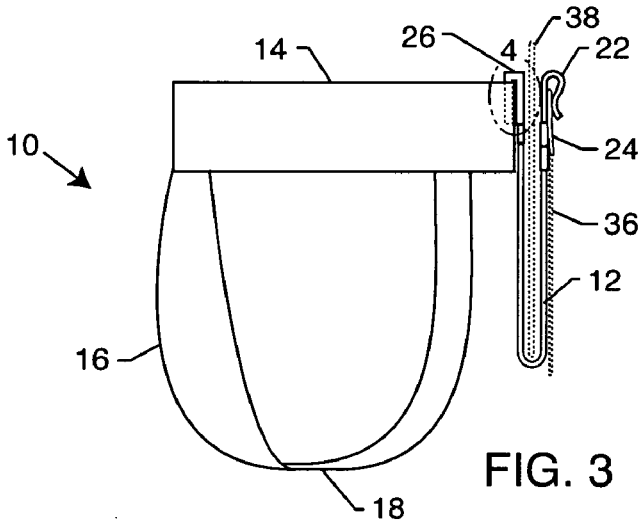
FIG. 3 is a side elevational view of the athletic supporter of FIG. 1.
Figure 4:
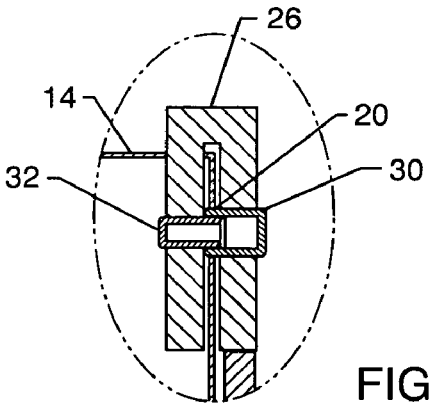
FIG. 4 is a close-up view of the identification strap shown in FIG. 3, taken along line 4—4.

As illustrated in FIGS. 1–4, the present invention is concerned with an improved athletic protective cup supporter 10 that includes an elongated identification strap 12. The athletic supporter 10 comprises an undergarment (or inner garment) that further includes a waistband 14, a cup pouch 16 located on the front of the athletic supporter 10 and extending downwardly from the waistband 14. The athletic supporter 10 may be made of an elastic fabric that allows a user to position a protective cup for maximum safety and protection. The athletic supporter 10 also includes at least two straps 18 which connect the waistband 14 to the cup pouch 16.

The cup pouch 16 is generally triangular and designed to contain a generally triangular protective cup (not shown). The protective cup may be manufactured of any suitable material, but is preferably formed of plastic. While the cup pouch 16 may be left open so as to allow the protective cup to be inserted and removed from the cup pouch, it may be permanently closed once the protective cup is inserted. The cup pouch 16 may be stitched closed so as to permanently incorporate the protective cup therein. Heavy stitching may be done at the factory in order to permanently incorporate the protective cup within the cup pouch 16. The straps 18 may be made of an elastic material and provide additional support for correcting the position of the athletic supporter 10 on the user. The waistband 14 may also be made of an elastic material.

The identification strap 12 may be securely attached to the waistband 14 at the rear of the athletic supporter 10, generally opposite the cup pouch 16. The waistband 14 includes an aperture 20 for connecting one end 21 of the strap 12 to the waistband 14. The opposite end 23 of the identification strap 12 includes a resilient clip 22 for holding an identifier 24. The identifier 24 may come in various forms including, without limitation, a flexible identification tag, an elongated piece of fabric or 'flag' (such as is used in playing flag football), a rectangular pocket or slot (with or without holes for connecting the pocket to the strap 12) with a transparent side (e.g., clear plastic layer) may cover the slot so as to enable a user to view a label or paper cutout, business cards, cards with logos, indicia and other markings or the like which are inserted into the pocket or to protect the contents of the pocket from the environment. The label or cutout may include various identifying information such as the user's name, corporate logo, player number, team name, etc.

The end 21 of the strap 12 includes a connector 26 which mechanically connects the strap 12 to the waistband 14. The connector 26 includes an elongated resilient body 28 having a male member 30 and a female member 32 for engaging the waistband 14 therebetween. The body 28 is bendable generally along at least one fold 34. The male member 30 is insertable through the aperture 20 to engage the female member 32 and operationally engage the waistband 14 therebetween. Alternatively, the connector 26 may include, without limitation, snaps, hook and loop fasteners, magnetic fasteners, adhesive surfaces or other means of securing the strap 12 to the athletic supporter 10. Alternatively, the strap 12 may be attached by heavy stitching to the supporter 10 to insure a strong attachment to the waistband 14. In another alternative, the fasteners on the connector 26 may engage mating fasteners on the waistband 14 instead of each other.

The identification strap 12 may be made from any suitable material, preferably plastic, though other materials may be used including, without limitation, cloth made of natural fibers, artificial fibers (e.g., nylon) or the like. From its point of attachment on the waistband 14, the identification strap 12 is designed to extend below and around the shirt tail 38 of the user's uniform top when the uniform top is tucked into the uniform pants or shorts 36 of the user. The strap 12 then extends upwards, between the shirttail 38 and the uniform pants or shorts 36, such that the clip 22 extends above and attaches to the waistband of the uniform pants or shorts 36 of the user. The identifier 24 should be easily visible when the user's uniform shirt or jersey is tucked into their outer garment (e.g., uniform pants or shorts) 36, which is beneficial not only to the athlete, but also to spectators, coaches, umpires and other supervisory personnel. The clip 22 operationally engages a waistband of the outer garment. The identifier 24 is configured so that it is capable of being used in almost all applications.

In use, the first end 21 of the elongated strap 12 is connected to the waistband 14 of the inner garment 10 having the cup supporting pocket 16 holding the protective cup.

The elongated strap 12 is looped from the waistband 14 of the inner garment 10 to the waistband of the outer garment 36 in an area between the inner and outer garments 10, 36. The looping further includes folding the strap 12 around the shirt tail 38 tucked into the area between the inner and outer garments 10, 36.

The second end 23 of the strap 12 is attached to the waistband of the outer garment 36. The identifier 24, in the form of an identification tag or the like, is secured on the second end 23 of the strap 12.

As part of connecting the first end 21 of the elongated strap 12 to the waistband 14 of the inner garment 10, the male portion 30 of the strap 12 is inserted through the aperture 20 of the waistband 14 of the inner garment 10 to engage the female portion 32 of the strap 12; operationally engaging the waistband 14 of the inner garment 10 therebetween. Another part of connecting the first end 21 of the elongated strap 12 to the waistband 14 of the inner garment 10 includes placing the protective cup in the cup supporting pocket 16.

The identifier 24, attached to the clip 22 at the back of the waistband of the outer garment may be made easily identifiable by design. The design may be formed directly on the identifier 24. The identifier 24 may be a bright color such as red, green, blue orange or otherwise matched to the colors traditionally associated with a particular professional sports team. The identifier 24 may also include a logo user's name, corporate logo, player number, team name, etc. The identifier 24 held by the clip 22 should extend down approximately two inches from the top of waistband of the user's uniform pants or shorts and is approximately one inch in width. Alternatively, the identifier 24 may also be four inches long and ¼ inch in width.

From the foregoing it is to be appreciated that the present invention provides a high reliable, simplified method by which a coach, umpire or athletic supervisor can identify athletes are wearing protective equipment, which effectively eliminates serious injury being incurred. The athletic supporter with cup 10 and identification strap 12 is easily identifiable as safety feature for all athletes.

In the alternative, a conventional athletic supporter may be retrofit to be used in conjunction with an identification strap, such as the one described above. A means of retrofitting a conventional athletic supporter makes it possible for the safety of conventional athletic supports to be improved. In this embodiment, the identification strap may be attached to a conventional athletic supporter by a fastening means in the form of snaps, hook and loop, magnetic or other means of securing the tag to the user's athletic supporter. The strap may include a base and a mount where the base attaches the mount to the waistband of the athletic supporter. The base may be attached to the athletic supporter in several ways including, but not limited to, stitching and adhesive. The mount may then be attached to the base using a fastening means in the form of snaps, hook and loop, magnetic or the like. The base and mount may be made from any suitable material, preferably plastic, though other materials may be used including, without limitation, cloth made of natural fibers, artificial fibers (e.g., nylon) or the like. The mount may be made easily identifiable by design. The design may be formed directly on the mount and the mount may be a bright color such as red, green, blue orange or otherwise matched to the colors traditionally associated with a particular professional sports team. The mount may also include a logo user's name, corporate logo, player number, team name, etc.

In another alternative, the identifier 24 may be incorporated into the back of the waistband 14 of the athletic cup supporter 10 by sewing the identifier 24 to the back of the waistband 14 with heavy thread and/or like material. The identifier 24 is preferably made of plastic and/or like material and approximately ¼ inches in width and four inches long. The identifier 24 may also be a predetermined color and/or include a logo that extends in front of and above the seat of the user's pants, shorts or uniform. This would allow for the identifier 24 to be attached to the top of the waistband 14 of the athletic supporter 10 and extend preferably 2 inches in front of the seat of the user's pants, shorts or uniform. The identifier 24 would be located above the user's backside so as to not be cumbersome and impact the user's athletic performance. In the alternative, the flexible identifier 24 may include a fastening means in the form of snaps, hook and loop, magnetic, adhesive or other means of securing the tag to the user's athletic supporter 10. A retrofit makes it possible for the safety of conventional athletic supports to be improved. In this embodiment, the identifier 24 may also be attached to a conventional athletic supporter by attaching a fastening device to identifier 24 in the form of snaps, hook and loop, magnetic or other means of securing the identifier 24 to the user's athletic supporter.

Although several embodiments have been described in detail for purposes of illustration, various modifications may be made without departing from the scope and spirit of the invention. Accordingly, the invention is not to be limited, except as by the appended claims.

What is claimed is:

1. An athletic protective cup supporter, comprising:

a waistband;

a cup supporting pocket connected to the waistband;

an elongated strap extending from the waistband and terminating at a resilient clip; and an identification tag associated with the clip to be worn on an outer garment to visibly indicate that the support is being worn.

2. The athletic protective cup supporter of claim 1, including a connector for attaching the strap and the waistband.

3. The athletic protective cup supporter of claim 2, wherein the connector includes a male portion and a female portion operationally engaging the waistband therebetween.

4. The athletic protective cup supporter of claim 2, wherein the waistband includes an aperture, and the connector includes a male portion insertable through the aperture to engage a female portion of the connector.

5. The athletic protective cup supporter of claim 4, wherein the male and female portions operationally engage the waistband therebetween.

6. The athletic protective cup supporter of claim 4, wherein the aperture is located through the waistband opposite the cup supporting pocket.

7. The athletic protective cup supporter of claim 1, wherein the waistband comprises a portion of an inner garment, and the clip operationally engages a waistband of an outer garment.

8. The athletic protective cup supporter of claim 1, including a cup in the cup supporting pocket, wherein the pocket is sewn shut.

9. An athletic protective cup supporter, comprising:

a waistband comprising an inner garment;

a cup supporting pocket connected to the waistband;

a connector for attaching the strap and the waistband;

a strap extending from the waistband and terminating at a resilient clip removably attachable to a waistband of an outer garment; and an identification tag associated with the clip to be worn on an outer garment to visibly indicate that the support is being worn.

10. The athletic protective cup supporter of claim 9, wherein the waistband includes an aperture and the connector includes a male portion insertable through the aperture to operationally engage a female portion of the connector.

11. The athletic protective cup supporter of claim 10, wherein the male and female portions capture a portion of the waistband therebetween.

12. The athletic protective cup supporter of claim 10, wherein the aperture is located on a portion of the waistband opposite the cup supporting pocket.

13. A method for identifying an athlete wearing an athletic protective cup supporter, comprising the steps of:

connecting a first end of an elongated strap to a waistband of an inner garment comprising a cup supporting pocket holding a protective cup;

looping the elongated strap from the waistband of the inner garment to a waistband of an outer garment in an area between the inner and outer garments; and attaching a second end of the strap to the waistband of the outer garment.

14. The method of claim 13, further comprising the step of securing an identification tag on the second end of the strap.

15. The method of claim 13, wherein the looping step further comprises the step of folding the strap around a shirt tail tucked into the area between the inner and outer garments.

16. The method of claim 13, wherein the connecting step further comprises the step of inserting a male portion of the strap through an aperture of the waistband of the inner garment to engage a female portion of the strap, operationally engaging the waistband of the inner garment therebetween.

17. The method of claim 13, wherein the connecting step further includes the step of placing the protective cup in the cup supporting pocket.

* * * * *